US005112047A

United States Patent [19]

Monneret

[11] Patent Number: 5,112,047

[45] Date of Patent: May 12, 1992

[54] TABLE FOOTBALL MACHINE

[75] Inventor: Alain Monneret, Montain-Voiteur, France

[73] Assignee: Monneret Jouets, France

[21] Appl. No.: 750,319

[22] Filed: Aug. 27, 1991

[30] Foreign Application Priority Data

Aug. 28, 1990 [FR] France ..... 90 10921

[51] Int. Cl.[5] ..... A63F 7/06

[52] U.S. Cl. ..... 273/85 D; 273/85 F

[58] Field of Search ..... 273/85 R, 85 B, 85 C, 273/85 D, 85 E, 85 F, 129 R, 129 S, 129 T, 119 R, 119 A, 119 B, 441, 459; D21/7, 9, 11, 14, 16–18, 20, 25, 27–29, 33–36

[56] References Cited

U.S. PATENT DOCUMENTS

| | | | |
|---|---|---|---|
| D. 216,473 | 1/1970 | Rizzo | D21/16 |
| 1,934,381 | 11/1933 | Slosson | 273/85 D |
| 2,507,258 | 5/1950 | Kohler | 273/85 B |
| 4,307,884 | 12/1981 | Remmler et al. | 373/85 D |

FOREIGN PATENT DOCUMENTS

| | | | |
|---|---|---|---|
| 938042 | 1/1956 | Fed. Rep. of Germany | 273/85 D |
| 1603055 | 2/1971 | Fed. Rep. of Germany | 273/85 D |
| 761661 | 3/1934 | France | 273/129 S |
| 771721 | 10/1934 | France | 273/85 E |
| 791758 | 12/1935 | France | 273/85 E |
| 1066485 | 6/1954 | France | 273/85 C |
| 1366465 | 6/1964 | France | 273/85 B |
| 506690 | 12/1954 | Italy | 273/85 F |
| 728955 | 12/1966 | Italy | 273/85 D |
| 176073 | 12/1935 | Switzerland . | |
| 197003 | 4/1938 | Switzerland | 273/85 D |
| 334675 | 1/1959 | Switzerland | 273/85 D |
| 870130 | 6/1961 | United Kingdom | 273/85 D |

*Primary Examiner*—William H. Grieb
*Assistant Examiner*—Sebastiano Passaniti
*Attorney, Agent, or Firm*—Oliff & Berridge

[57] ABSTRACT

This table football machine is of the type having a box structure whose rectangular base reproduces a football pitch, in which each transverse vertical wall has an opening corresponding to a goal mouth and whose longitudinal vertical walls carry bearings for eight horizontal rods which are disposed transversely and each of which, mounted pivotably and axially sliding in its end bearings, carries one or more figurines or players of a single team, and is provided, at one of its ends, with a maneuvering handle, all the rods supporting players of a single team being disposed with their maneuvering handles located outside the same longitudinal wall. On the one hand, each rod is composed of a single element and, on the other hand, each longitudinal wall has, at least in the region of each bearing supporting the free end of a rod, a thickness at least equal to the axial travel of this rod.

2 Claims, 2 Drawing Sheets

II
II
2
3
4
4
5
5
5'
5'
5'
6
6
7
7
8
11a
11b
11c
11d
11'a
11'b
11'c
11'd
12a
12b
12c
12d
12'a
12'b
12'c
12'd
13
14
15
16
16
17a
17b
17c
18a
18b
18c

TABLE FOOTBALL MACHINE

BACKGROUND OF THE INVENTION

The present invention relates to a table football machine, that is to say a table football game comprising a box structure whose rectangular base reproduces a football pitch, in which each transverse vertical wall has, in its center, an opening corresponding to a goal mouth and whose longitudinal vertical walls carry bearings for eight horizontal rods which are disposed transversely to the longitudinal direction of the box structure and each of which, mounted pivotably and axially sliding in its end bearings, carries one or more figurines or players of a single team, according to its location on the box structure with their feet level with the base of the box structure, and is provided, at one of its ends, with a maneuvering handle, all the rods supporting players of a single team being disposed with their maneuvering handles located outside the same longitudinal wall of the box structure.

A game of table football consists in maneuvering the rods supporting the players in order to strike a ball representing the football in order to convey it into the goal mouth of the opposing team while preventing it from entering one's own goal mouth. To this end, four participants are generally envisaged, two for each team, each of whom holds in each hand the maneuvering handle of one player-support rod.

DESCRIPTION OF THE PRIOR ART

In the first known table football machines of this type, the ends of the rods projected entirely outside the longitudinal walls of the box structure such that an axial displacement of a rod in the direction of its free end by one of the participants in the game risked injuring the opponent located on the side of this free end.

To eliminate this risk, table football machines have been produced in which each rod consists of two coaxial elements mounted so as to slide one inside the other, such that the end of this rod opposite to that which is equipped with a maneuvering handle remains stationary, without ever projecting beyond the longitudinal wall supporting it, while the free end of the element equipped with the maneuvering handle is displaced axially only relative to the stationary element. However, coaxial and sliding assembly of the two elements of each rod is expensive if implemented under satisfactory conditions of strength and durability.

SUMMARY OF THE INVENTION

The present invention aims to remedy all these drawbacks. To this end, in the table football machine to which it relates, on the one hand, each rod is composed of a single element and, on the other hand, each longitudinal wall of the box structure has, at least in the region of each bearing supporting the free end of a rod, a thickness at least equal to the axial travel of this rod so as to be able to receive this free end regardless of the axial position of the rod.

Thus, the free ends, that is to say those ends not provided with maneuvering handles, of the bars never project outside the wall supporting them since they are always housed inside this wall.

According to a preferred embodiment of the invention, each longitudinal wall has, in the region of each bearing supporting that end of a rod which is equipped with a maneuvering handle, a recess capable of receiving the maneuvering handle of this rod when it is displaced axially as far as its end of travel position in the direction of its free end, some of these recesses being capable of receiving two handles of two adjacent rods equipped therewith, on the same side of the box structure.

DESCRIPTION OF THE DRAWINGS

In any case, the invention will be satisfactorily understood with the aid of the following description and with reference to the appended schematic drawing which represents, by way of nonlimiting example, an embodiment of this table football machine.

DESCRIPTION OF THE PREFERRED EMBODIMENT

Figure 1:
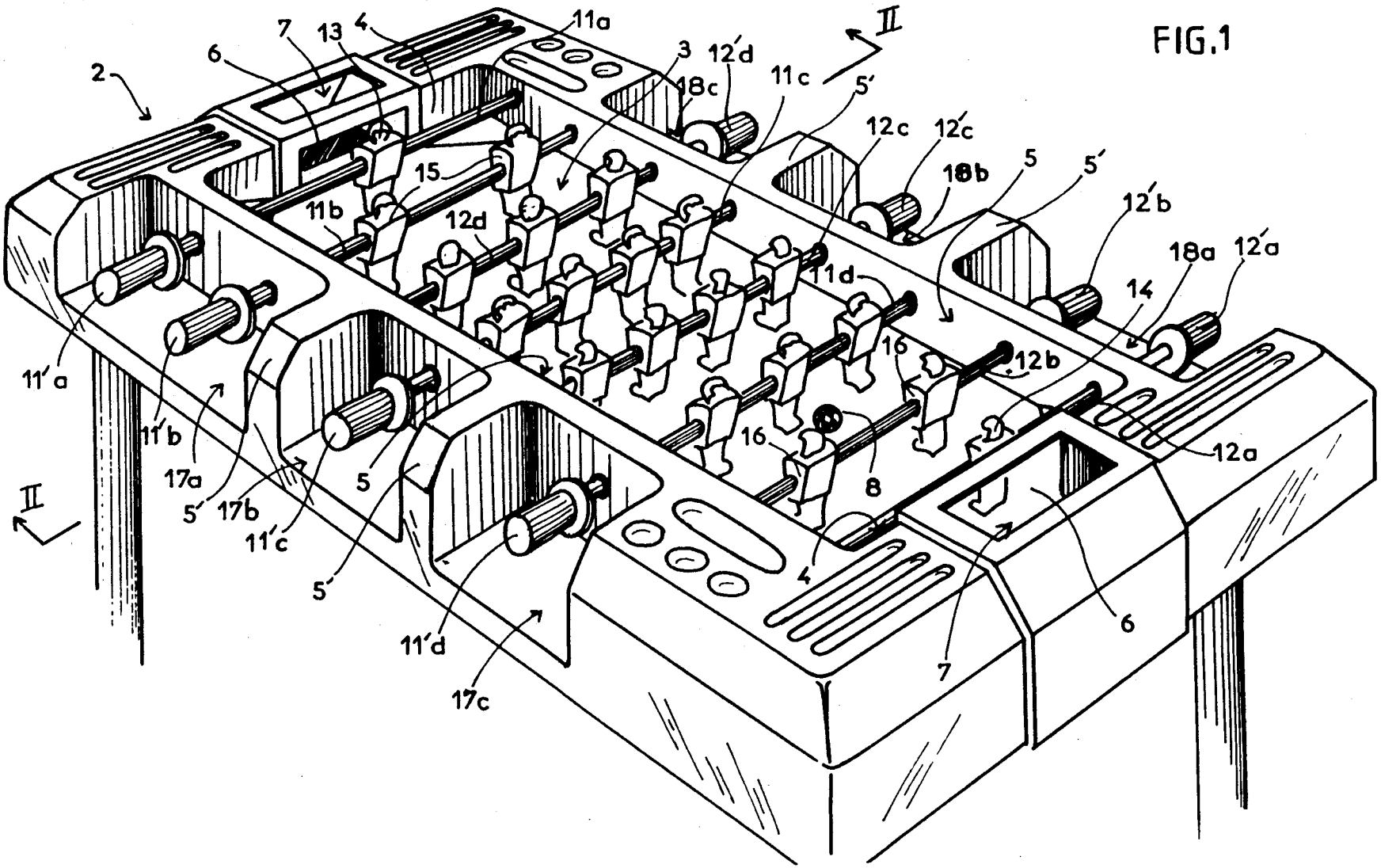
FIG. 1 is a perspective view thereof.

As shown in the drawing, this table football machine consists, as is known per se, of a box structure 2 whose rectangular base 3, which reproduces a football pitch, is surrounded by four vertical walls, namely two transverse walls 4 and two longitudinal walls 5.

In the center of each transverse wall 4 is provided an opening 6 forming a goal mouth, at the rear of which is arranged a cavity 7 intended to retain the ball 8 serving as the football each time that a goal is scored by penetration of this ball 8 into the opening 6 of the corresponding goal mouth.

The longitudinal walls 5 of the box structure 2 support, by means of bearings 9, horizontal rods 11*a* to 11*d* and 12*a* to 12*d*, disposed transversely to the longitudinal direction of the base 3, that is to say parallel to the transverse walls 4 of the box structure 2. Each rod 11*a* to 11*d* and 12*a* to 12*d* supports one or more figurines, each of which represents a player from one of the two table-football teams opposing each other on the pitch formed by the base 3 of the box structure 2, a single rod supporting only players from a single team.

With the exception of the rods 11*a*, 11*b* on the one hand and 12*a*, 12*b* on the other hand, which support, respectively, the goalkeepers 13 and 14 and the left and right backs 15 and 16 of the two teams and which are adjacent to one another, the other rods, that is to say 11*c*, 11*d* on the one hand and 12*c*, 12*d* on the other hand, are disposed alternately, that is to say that each of them is between two rods supporting players from the opposing team.

Each rod 11*a* to 11*d*, 12*a* to 12*d* is mounted freely pivoting and axially sliding in its bearings supported by the longitudinal walls 5 of the box structure 2. Naturally, the slide travel of each rod is limited as a function of the number and the position of the players it supports.

Each rod 11*a* to 11*d* and 12*a* to 12*d* is equipped, at one of its ends, with a maneuvering handle 11'*a* to 11'*d*, enabling the participant in this table-football game to twist it and slide it at will while its opposite end is free.

Moreover, all the rods 11*a* to 11*d* on the one hand and 12*a* to 12*d* on the other hand are disposed such that their maneuvering handle is located outside the same longitudinal wall 5 of the box structure 2.

A table-football game consists in bringing together four participants who take up positions in pairs along each side of the longitudinal sides 5 of the box structure 2, each pair of participants being intended to maneuver the rods 11*a* to 11*d* and 12*a* to 12*d*, respectively, supporting the players of a single team. Each participant thus holds two maneuvering handles, one in each hand.

The aim of the game is to maneuver the rods supporting the players of one's team so as to cause the ball 8 to penetrate into the opening 6 delimiting the opposing goal mouth, while preventing the opposing players from causing this ball 8 to penetrate into the opening 7 delimiting one's own goal mouth.

According to the invention, in order to eliminate any risk of injury to one of the participants, caused by the free end of a rod, particularly when it is displaced axially in the opposite direction from its maneuvering handle, at least in the zone of the bearing 9 supporting this free end, the longitudinal wall has a width at least equal to the maximum axial travel of this rod so that this free end is always housed inside the thickness of the wall 5 which supports its bearing 9 without ever projecting outside this wall.

As shown in the drawing and, particularly, in FIG. 1, in order to avoid the maneuvering handles 11'*a* to 11'*d* and 12'*a* to 12'*d* permanently projecting from the walls 5, which would increase the size of this table football machine to no useful purpose, in the zone of each bearing 9 corresponding to a maneuvering handle, each wall 5 has a recess 17*a* to 17*c* and 18*a* to 18*c* capable of receiving this handle when the rod with which it is associated is displaced to the end of travel in the direction of its free end.

As shown in the drawing, only three recesses are provided for each series of four maneuvering handles corresponding to the rods of a single team, since a single recess, 17*a* and 18*a* respectively, serves to receive the maneuvering handles 11'*a*, 11'*b* and 12'*a*, 12'*b* respectively, of the rods 11*a*, 11*b* and 12*a*, 12*b* supporting the left and right backs 15 and 16, respectively, and the goalkeepers 13 and 14, respectively, of the two teams, since these rods are adjacent to each other in pairs. On the other hand, the other recesses 17*b*, 17*c* and 18*b*, 18*c* serve to receive only a single maneuvering handle 11'*c* or 11'*d* and 12'*c* or 12'*d*, each being separated from its neighbor by a portion 5' of greater width than the corresponding wall 5.

Figure 2:
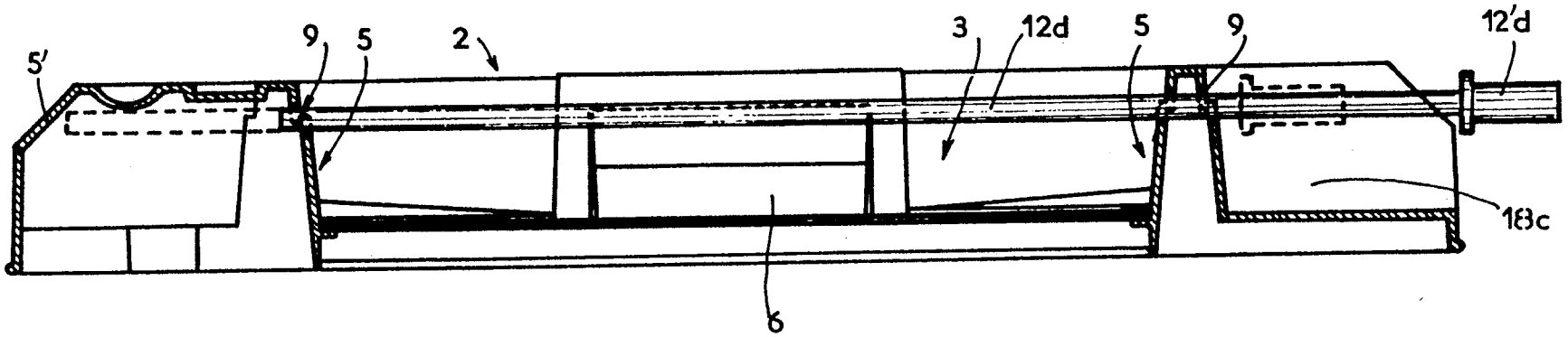
FIG. 2 is a cross-sectional view thereof along II—II of FIG. 1.

FIG. 2 shows the bar 12*d*, in solid lines, in one of its extreme positions and, in broken lines, in its other extreme position. Examination of this figure reveals that, in their two extreme positions, the free ends of the rods are always housed inside the longitudinal walls 5 without ever projecting outside these walls and that, in one of their extreme positions, the maneuvering handles of these rods are also retracted inside the recesses provided to serve as a housing for them in this extreme position.

It should also be noted that the arrangement of the table football machine according to the invention does not involve any weakening of the rods supporting the players and that there is, moreover, no notable effect on its cost price.

I claim:

1. A table football machine comprising a box structure having a rectangular base that reproduces a football pitch, a pair of transverse vertical walls and a pair of longitudinal vertical walls having a first width; each of said transverse vertical walls having, in its longitudinal center, an opening corresponding to a goal mouth and wherein each of said longitudinal vertical walls carries end bearings for receiving a plurality of horizontal rods; each of said rods having a free end and an opposite extreme end and being disposed generally above said base and transversely to the longitudinal direction of the box structure and slidably extendable beyond the width of said longitudinal vertical walls; each of said horizontal rods being freely, pivotally mounted and axially slidable in its respective end bearings and carrying, thereupon, one or more figurines or players; each of said figurines designating a single team member according to its location within the box structure; each figurine comprising opposite horizontal ends disposed in abutting relation to the horizontal rod upon which said figurine is mounted; each figurine having a foot portion disposed generally away from said horizontal rod, wherein a lowermost extent of said foot portion of each of said figurines is substantially level with the base of the box structure; each of said extreme ends of each of said horizontal rods being provided with a player operable maneuvering handle, wherein all of said rods supporting figurines that designate a single team are disposed with their respective maneuvering handles located exterior to the first width along the same longitudinal vertical wall; each horizontal rod being composed of a single element and wherein each longitudinal vertical wall of the box structure comprises, exterior to said first width and at least in a region housing each of said end bearings that support the free end of each of said horizontal rods; a housing having a thickness dimensionally greater than said first width and equal to at least the length of the axial travel of said free end beyond said width of said longitudinal vertical wall; said housing receiving and fully enclosing said free end when said free end is displaced to its maximum axial travel exterior to the first width of the longitudinal vertical walls of the box structure.

2. The table football machine as claimed in claim 1, wherein each longitudinal vertical wall has, exterior to said first width and in a region housing each of said end bearings that support the extreme end of each of said horizontal rods which is equipped with a maneuvering handle, a recess capable of receiving the maneuvering handle when said rod is displaced towards said first width to its maximum extent of axial travel in a direction of the free end of the horizontal rod; some of said recesses being capable of receiving a plurality of handles of a plurality of adjacently disposed rods along the same longitudinal vertical wall of the box structure.

* * * * *